US007077520B2

(12) United States Patent
Ikeda et al.

(10) Patent No.: US 7,077,520 B2
(45) Date of Patent: Jul. 18, 2006

(54) ELECTROPHOTOGRAPHIC APPARATUS

(75) Inventors: Yoshimichi Ikeda, Hitachinaka (JP); Yoshihiko Sano, Hitachinaka (JP); Satoshi Ueda, Hitachinaka (JP)

(73) Assignee: Ricoh Printing Solutions, Ltd., Tokyo (JP)

( * ) Notice: Subject to any disclaimer, the term of this patent is extended or adjusted under 35 U.S.C. 154(b) by 37 days.

(21) Appl. No.: 10/864,634

(22) Filed: Jun. 10, 2004

(65) Prior Publication Data

US 2004/0253007 A1 Dec. 16, 2004

(30) Foreign Application Priority Data

Jun. 13, 2003 (JP) ..... 2003-169141

(51) Int. Cl.
*G03G 15/00* (2006.01)

(52) U.S. Cl. ..... 351/178; 399/12; 399/25; 399/27

(58) Field of Classification Search ..... 399/12, 399/24, 25, 27, 28, 111, 112, 119, 120, 178
See application file for complete search history.

(56) References Cited

U.S. PATENT DOCUMENTS 5,063,410 A * 11/1991 Kinoshita et al. ..... 399/12
6,754,454 B1 * 6/2004 Hiroshima et al. ..... 399/25

FOREIGN PATENT DOCUMENTS

JP 2001-255728 9/2001

* cited by examiner

*Primary Examiner*—Hoang Ngo
(74) *Attorney, Agent, or Firm*—Antonelli, Terry, Stout and Kraus, LLP.

(57) ABSTRACT

An electrophotographic apparatus is equipped with one or more printing sections including a photoreceptor, a charger that electrically charges the surface of the photoreceptor, an optical scanning section that optically scans the surface of the charged photoreceptor with a laser beam, a developer that develops image areas formed by optical scanning, a toner hopper that supplies toner to the developer, and an image transfer unit that transfers the developed image to a recording member. In this apparatus, the developer and toner hopper can be mounted and demounted separately and a plurality of toner hoppers and developers are changeable according to the kinds of toner colors to be used. Thus, of the developers and toner hoppers is equipped with a device that outputs electric signals to detect the correspondences of the toner hoppers and the developers.

8 Claims, 4 Drawing Sheets

FIG. 4A

| COLOR NUMBER | COLOR | BIT | CODE |
|---|---|---|---|
| 8 | COLOR D | 7 | 80h |
| 7 | COLOR C | 6 | 40h |
| 6 | COLOR B | 5 | 20h |
| 5 | COLOR A | 4 | 10h |
| 4 | YELLOW | 3 | 08h |
| 3 | BLUE | 2 | 04h |
| 2 | RED | 1 | 02h |
| 1 | BLACK | 0 | 01h |

FIG. 4B

| COLOR NUMBER | COLOR | CODE |
|---|---|---|
| 254 | COLOR Z | FEh |
| · | · | · |
| 6 | COLOR B | 06h |
| 5 | COLOR A | 05h |
| 4 | YELLOW | 04h |
| 3 | BLUE | 03h |
| 2 | RED | 02h |
| 1 | BLACK | 01h |

FIG. 5A

| | COLOR NUMBER | COLOR/ SET | BIT | CODE |
|---|---|---|---|---|
| SET | 4 | SET 4 | 7 | 80h |
| | 3 | SET 3 | 6 | 40h |
| | 2 | SET 2 | 5 | 20h |
| | 1 | SET 1 | 4 | 10h |
| COLOR | 4 | YELLOW | 3 | 08h |
| | 3 | BLUE | 2 | 04h |
| | 2 | RED | 1 | 02h |
| | 1 | BLACK | 0 | 01h |

FIG. 5B

| | COLOR NUMBER | COLOR/ SET | CODE |
|---|---|---|---|
| SET | 4 | SET Z | E0h |
| | · | SET 3 | · |
| | 6 | SET 2 | 20h |
| | 5 | SET 1 | 10h |
| COLOR | 14 | COLOR Z | 0Eh |
| | · | · | · |
| | 2 | RED | 02h |
| | 1 | BLACK | 01h |

ELECTROPHOTOGRAPHIC APPARATUS

BACKGROUND OF THE INVENTION

This invention relates to an electrophotographic apparatus, such as a laser beam printer and a copying machine, whose toner hoppers and developers can be replaced by its user or a maintenance engineer.

Referring to FIG. 7, the general configuration of a laser printer whose toner hopper 1 and a developer 2 can be replaced by its user will be explained. For example, an electrophotographic apparatus is typically equipped with one or more printing sections comprising a photoreceptor 8, a charger 9 that electrically charges the surface of the photoreceptor 8, an optical scanning section 10 that optically scans the surface of the charged photoreceptor 8 with a laser beam, a developer 2 that develops image areas that are scanned optically, a toner hopper 1 that supplies toner 11 to said developer 2, and an image transfer unit 13 that transfers the developed image to a recording member 12. With such an arrangement, it is possible to print multi-color images on a single laser printer by replacing the set of elements consisting of the toner hopper 1 and the developer 2. This is also applicable to MICR toner (toner for magnetic ink character recognition).

In the above-described laser printer, a user or a maintenance engineer replaces the toner hopper 1 and the developer 2. At the time of this replacement, the toner hopper 1 (for example, containing red toner) may be combined with the wrong developer 2 (for example, containing a blue toner), so that the image printing may fail. To prevent this, various contrivances have been proposed.

Referring to FIG. 8, one of the conventional techniques used in full-color laser printers will be explained. This example is comprised of a slit disk 16 that is mounted on the shaft of a rotating means 15 disposed in a toner cartridge 14, which disk 16 has some equally-spaced slits on its circumference; a photo sensor that is provided opposite to the slit disk 16 to detect the presence of respective slits of the disk 16 as the disk rotates; a pulse signal generator 18 that generates a pulse signal responsive to detection of each slit of the disk 16 as the disk rotates; and a detector 3 that detects the kind of a toner cartridge 14 from the pulse signal. Generally, a full-color laser printer contains four printing sections which provide for use of four kinds of toner (yellow, magenta, cyan, and black) to form color images. Therefore, the laser printer requires four toner cartridges 14. Similarly, the pulse signal generator 18 must have four slit disks 16 that have different slit intervals to distinguish the toner cartridges 14 properly. (For example, see Japanese Application Patent Laid-Open Publication No. 2001-255728 (Page 3–7, FIG. 3))

Referring to FIG. 9, a general technique for effecting proper combination of a toner hopper and a developer will be explained. FIG. 9A shows a means to prevent a wrong combination of toner hoppers and developers. FIG. 9B shows examples of a key configuration used for this purpose. In FIG. 9A, plural keys 19 are provided in the part where the toner hopper 1 is connected to the developer 2 to prevent wrong hopper-developer combinations. FIG. 9B-(i a) shows the shape of a key 20 for a toner hopper containing red toner and the shape of a key 21 of the developer 2 containing red toner. The projection and recess of these keys are formed to fit each other. Similarly, FIG. 9B-(*b*) shows the shape of a key 22 for a toner hopper containing blue toner and the shape of a key 23 of the developer 2 containing blue toner. The projection and recess of these keys are formed to fit each other. However, in FIG. 9B-(*c*), it can be seen that the key 22 of the toner hopper containing blue toner does not fit to the key 21 of the developer 2 containing red toner.

Generally, a full-color laser printer uses four kinds of toner (yellow, magenta, cyan, and black) to form full color images. In other words, the printer requires four toner hoppers and four developers. Therefore, a spot color printer that has at least one printing section and forms images without mixing toners must prepare some dozens of toner colors to meet a user's requests.

SUMMARY OF THE INVENTION

Usually, a laser printer generally stores information concerning the quantity of consumption to indicate the timing to replace expendables and specific control values in a non-volatile memory. This procedure is also applicable to the toner hoppers and developers. In the case of a printer which has a toner hopper and a developer that cannot be replaced, the printer stores information concerning the quantity of toner consumption related to the toner hopper and the developer and specific control values in a non-volatile memory on a control board in the printer. On the other hand, in the case where the toner hopper and the developer are replaceable, such information and specific control values before and after replacement may be mixed up after the toner hopper and the developer are replaced, if the printer stores such information and values at an address of the non-volatile memory on the control board. To avoid this, conventional printers use a method of providing a non-volatile memory in their toner hoppers or developers. When a developer has a non-volatile memory, the data in the non-volatile memory contains information concerning a corresponding toner hopper. For example, when a printer has two sets of a toner hopper and a developer for red toner, information of one of the red toner hoppers is stored in the non-volatile memory of the corresponding developer only. If this red toner hopper is connected to the other developer, different control may result from wrong information. In other words, when a spot color printer or the like has at least one printing section and does not mix toners to form color mages, only providing means to distinguish toner hoppers and developers for respective colors is not enough. If the user requires some dozens of toner colors, the printer must provide further means to distinguish them.

However, the above-described conventional technology must provide very complicated slit disks and many hopper-developer engagement keys. This technology makes the printer product very expensive (because of the costs to make the slit disks and key dies).

An object of this invention is to provide an electrophotographic apparatus that can detect hopper-developer correspondences by use of electric signals of the toner hoppers and the developers without using many complicated and expensive parts to detect such correspondences.

The above-stated object can be attained by providing a means such as a DIP switch or non-volatile memory to output electric signals on each of the toner hoppers and the developers, assigning codes corresponding to toner colors to electric signals, and detecting the correspondences of toner hoppers and developers by use of the electric signals.

BRIEF DESCRIPTION OF THE DRAWINGS

FIGS. 4A and 4B are diagrams which show an example of assignment of 8-bit data codes to a toner hopper and a developer according to toner colors.

FIGS. 5A and 5B are diagrams which show an example of assignment of 4-bit data codes to toner hoppers and developers according to toner colors and assignment of set codes to toner hoppers and developers of the same color, if any.

DESCRIPTION OF THE PREFERRED EMBODIMENTS

Figure 1:
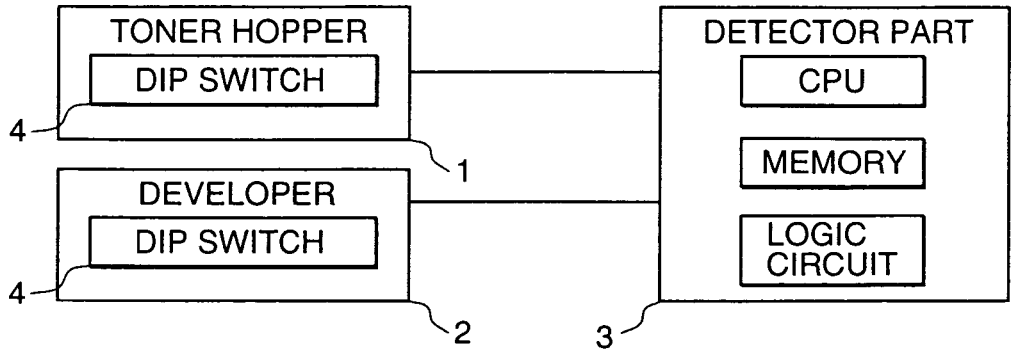
FIG. 1 is a block diagram which shows an embodiment of this invention, in which a toner hopper and a developer respectively contains a DIP switch.

Referring to FIG. 1, an embodiment concerning first and second aspects of this invention will be explained. The toner hopper 1 and the developer 2, respectively, have a DIP switch 4 which is connected to a detecting section comprising a CPU, a memory, and a logical circuit. For example, when the DIP switches are respectively 8 bits long, a hexadecimal code "01h" is assigned to a black toner hopper 1 and a developer 2 that contains black toner. Similarly, a hexadecimal code "02h" is assigned to a red toner hopper 1 and a developer 2 that contains red toner. The DIP switches are respectively set to "01h" and "02h."

When the black toner hopper 1 is engaged with the developer 2 containing black toner, the DIP switch 4 in the black toner hopper 2 outputs code "01h" and the DIP switch 4 in the developer 2 containing a black toner outputs code "01h," too. These codes "01h" are output to the detector 3. When the same codes "01h" are received from the toner hopper 1 and the developer 2, the detector judges that the toner hopper 1 and the developer 2 are correspond to each other and permits the laser printer to start printing without outputting an error message.

However, when the black toner hoper 1 is combined with the developer 2 containing red toner, the DIP switch 4 in the black toner hopper 1 outputs code "01h" and the DIP switch 4 in the developer 2 containing red toner outputs code "02h." These codes "01h" and "02h" are output to the detector 3. When these different codes "01h" and "02h" are received from the toner hopper 1 and the developer 2, the detector judges that the toner hopper 1 (including black toner) and the developer 2 (including red toner) do not correspond with each other, and so an error message is outputted, and the laser printer is not allowed to start printing.

Figure 2:
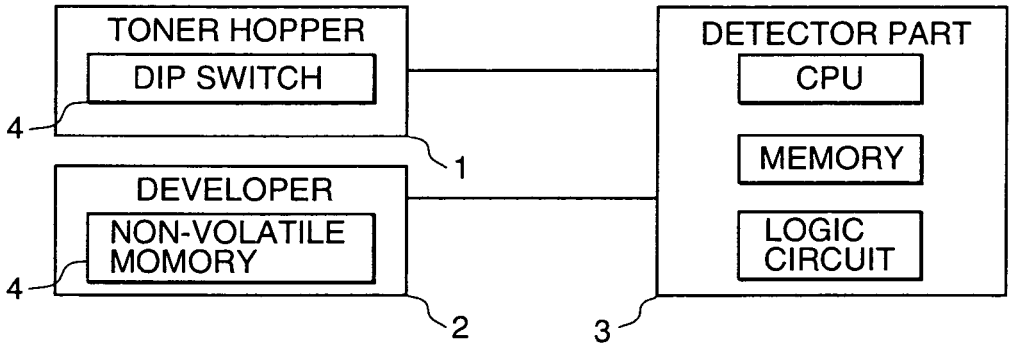
FIG. 2 is a block diagram which shows an embodiment of this invention, in which a toner hopper contains a DIP switch and a developer contains a non-volatile memory.

In accordance with the third and fourth aspects of this invention, at least either the toner hopper 1 or the developer 2 has a non-volatile memory. First, with reference to FIG. 2, a case in which only the developer 2 has a non-volatile memory 5 will be explained. The toner hopper 1 has a DIP switch 4 and the developer 2 has a non-volatile memory 5. The DIP switch 4 and the non-volatile memory 5 are respectively connected to a detector 3 comprising a CPU, memory, and a logic circuit. For example, when the DIP switch 4 and the non-volatile memory 5 are respectively 8 bits long, a hexadecimal code "01h" is assigned to a black toner hopper 1 and to a developer 2 that contain a black toner. Similarly, a hexadecimal code "02h" is assigned to a red toner hopper 1 and to a developer 2 that contains red toner. The DIP switch 4 in the toner hopper 1 is set to code "01h" and data at a preset address in the non-volatile memory in the developer 2 is set to "02h." To check the hopper-developer correspondence, the detector checks the codes sent as electric signals from the toner hopper and the developer 2 in a similar way and permits the printer to start printing when the codes are identical or does not allow the printer to start printing when the codes are different. This is applicable also when only the toner hopper 1 has a non-volatile memory.

Figure 3:
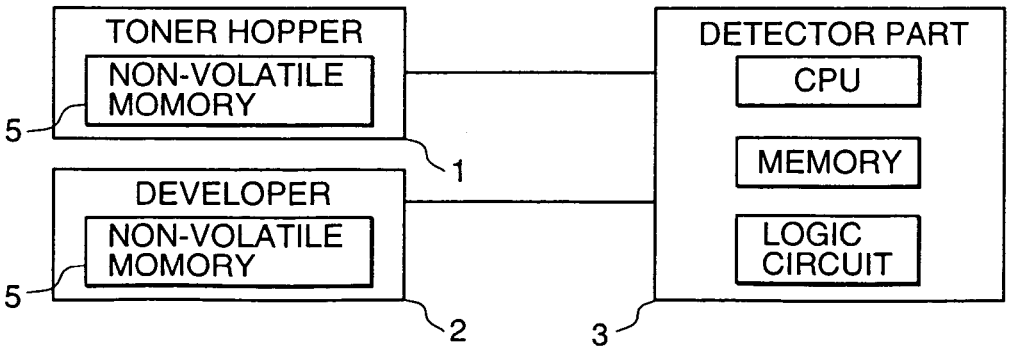
FIG. 3 is a block diagram which shows an embodiment of this invention, in which a toner hopper and a developer respectively contain a non-volatile memory.

FIG. 3 shows a case in which both the toner hopper 1 and the developer 2 have a non-volatile memory 5. These non-volatile memories are respectively connected to a detector comprising a CPU, memory, and a logic circuit.

For example, when the data lengths of the non-volatile memories 5 are each 8 bits long, a hexadecimal code "01h" is assigned to a black toner hopper 1 and to a developer 2 that contains black toner. Similarly, a hexadecimal code "02h" is assigned to a red toner hopper 1 and to a developer 2 that contains red toner. The contents at preset addresses in the non-volatile memories of the toner hopper 1 and the developer 2 are respectively set to "01h" and "02h." To check the hopper-developer correspondence, the detector checks the codes sent as electric signals from the toner hopper and the developer 2 in a similar way and permits the laser printer to start printing when the codes are identical or does not allow the printer to start printing when the codes are different. Further, when the toner hopper 1 or the developer 2 has both a DIP switch 4 and a non-volatile memory 5, a code can be assigned to any of them.

A fifth aspect of this invention is related to the assignment of said codes. FIGS. 4A and 4B show examples of an 8-bit code assignment to a toner hopper 1 and to a developer 2. In FIG. 4A, each toner color is assigned to each data bit. For example, black, red, and blue are assigned to bit 0, bit 1, and bit 2 in that order. Other toner colors can be assigned to the other data bits in a similar manner. This enables recognition of toner hoppers 1 and developers 2 for toners of eight colors.

In FIG. 4B, color codes are assigned to combinations of data bits instead of by bit-by-bit assignment. You can assign 256 colors by assigning each color to a respective hexadecimal value, for example, black to "01h," red to "02h," blue to "03h," and so on including "00h" and "FFh", or 254 colors not including "00h" and "FFh."

A sixth aspect of this invention uses set codes in the assignment of color codes when the printer has a plurality of toner hoppers and a plurality of developers that contain toners of identical colors. FIGS. 5A and 5B show examples of the assignment of color codes of four data bits long and set codes of four data bits long to the toner hoppers 1 and the developers 2. In FIG. 5A, toners of respective colors are assigned in bits, and, further, it is possible to recognize toner hoppers 1 and developers 2 for four toner colors and four sets of toner hoppers 1 and developers 2 of the same color by assigning bit 4 to the first set of a toner hopper 1 and a developer 2 of the same color, bit 1 to the second set, bit 2 to the third set and so on. For example, when the first set of the yellow toner hopper 1 and the developer 2 for yellow toner are used, bits 3 and 4 are selected and code "18h" is output. When the second set of the yellow toner hopper 1 and the developer 2 for a yellow toner are used, bits 3 and 5 are selected and code "28h" is output. In this way, it is possible to distinguish the toner hopper 1 and the developer 2 from those of the same color.

In FIG. 5B, toner colors are assigned to combinations of data bits, and further, it is possible to assign toner hoppers 1 and developers 2 for 16 toner colors and 16 sets of toner hoppers 1 and developers 2 of the same color, for example, by assigning "10h" to the first set of a toner hopper 1 and a developer 2 of the same color, "20h" to the second set, and so on, including "00h" and "FFh", or toner hoppers 1 and developers 2 for 16 toner colors and 16 sets of toner hoppers 1 and developers 2 of the same color and the like, not including "00h" and "FFh." For example, when the first set of a red toner hopper 1 and a developer 2 for red toner is selected, a code "12h" is output. When the second set of a red toner hopper 1 and a developer 2 for red toner is selected, a code "22h" is output. In this way, it is possible to distinguish the toner hopper 1 and the developer 2 from those of the same color.

In accordance with a seventh aspect of this invention, codes to toner hoppers 1 and developers 2 are assigned independently of toner colors. When data of the DIP switches 4 or non-volatile memory 5 in the toner hoppers 1 and the developers 2 are respectively 8 bits long, it is possible to distinguish toner hoppers 1 and developers 2 of the same colors. For example, assuming a purchase has been made of toner hoppers 1 and developers 2 for a blue toner, a red toner, a black toner, and again a red toner in this order, it is possible to distinguish them by assigning "01h" to those for a blue toner, "02h" to those for a red toner, "03h" to those for a black toner, and "04h" to the second set of a toner hopper and a developer for a red toner.

Figure 6:
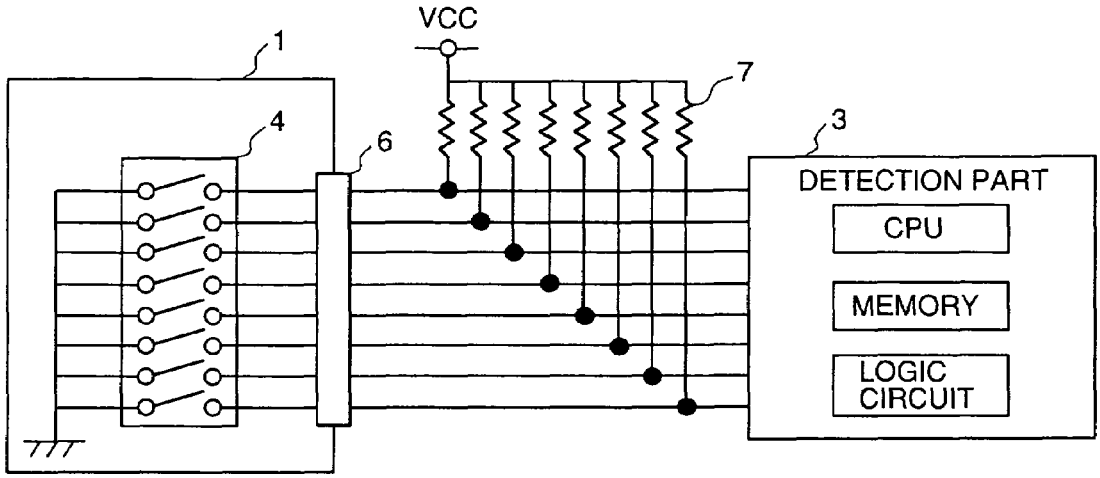
FIG. 6 is a schematic diagram which shows an example of the configuration of a DIP switch circuit whose bits represent a code of a toner hopper in accordance with the embodiment of this invention.
Figure 7:
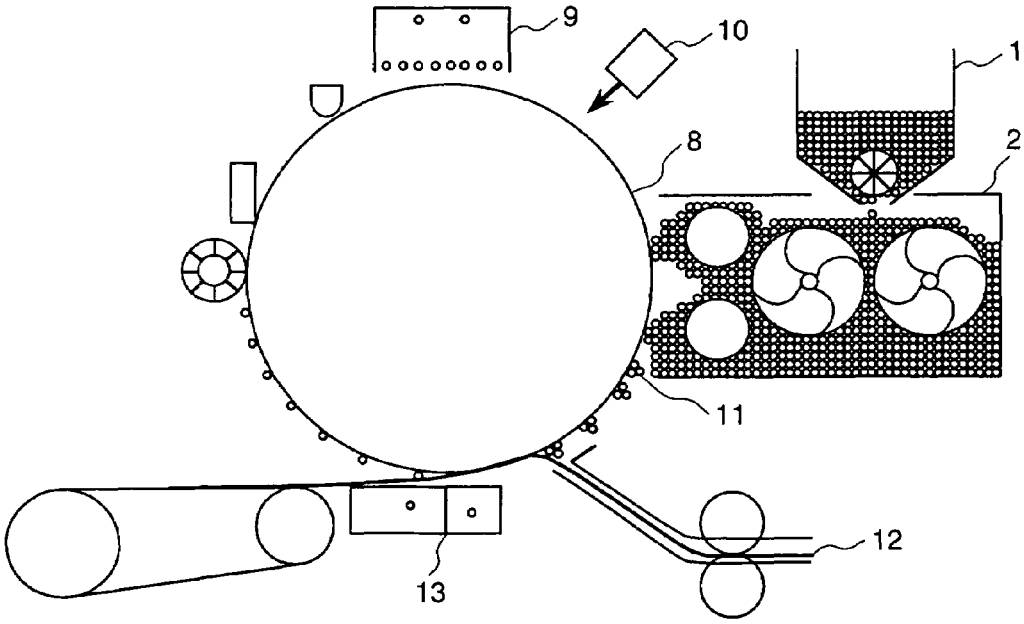
FIG. 7 is a schematic diagram of an electrophotographic processing apparatus.
Figure 8:
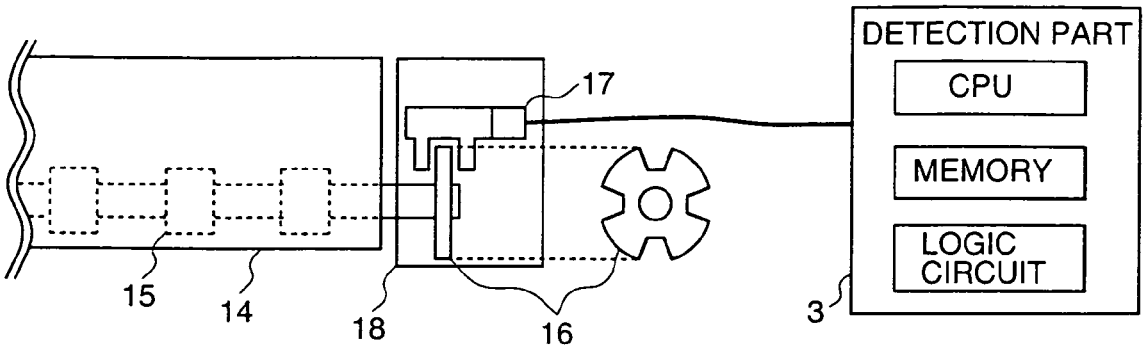
FIG. 8 is a diagram which shows a configuration of a conventional means to detect the correspondence of a toner cartridge using a slit disk.
Figure 9A:
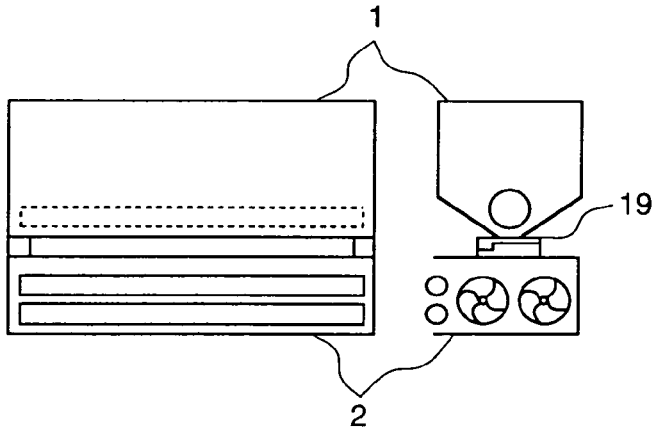
FIGS. 9A and 9B are diagrams which show conventional means to mechanically prevent a wrong combination of a toner hopper and a developer.
Figure 9B:
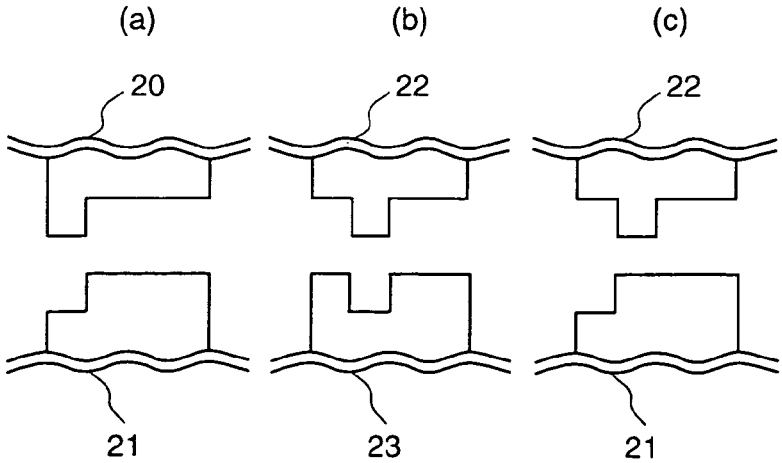

According to an eighth aspect of this invention, codes that generate electric signals of all zeros or all ones are not assigned to toner hoppers 1 and developers 2. In other words, when data of the DIP switches 4 or non-volatile memory 5 in the toner hoppers 1 and the developers 2 are respectively 8 bits long, only codes "01h" to "FEh" are available. The reason for this will be explained below with reference to FIG. 6. FIG. 6 shows an example of a circuit containing a DIP switch of 8 bits long to determine the code of a toner hopper 1. One end of each data bit of the DIP switch is grounded and the other end of each bit is connected to a detector 3 through a connector 6. Each signal is pulled up to Vcc through a resistor 7. In this circuit configuration, each bit becomes "0" when its micro-switch of the DIP switch 4 is turned on or becomes "1" when its micro-switch of the DIP switch 4 is turned off. If you assign a code "FFh" that generates an electric signal of all ones to a black toner hopper 1, you cannot tell it from another signal pattern "FFh" that represents a disconnection of the connector 6. When a code that generates an electric signal of all zeros or all ones is not assigned, it is possible to easily recognize a disconnection of the connector 6 (that is a disconnection of the toner hopper).

As explained above, this invention enables detection of correspondences of toner hoppers 1 and developers 2 by use of electric signals generated by the toner hoppers 1 and the developers 2, instead of using a lot of complicated parts to detect correspondences of toner hoppers 1 and developers 2.

In accordance with this invention, an electrophotographic apparatus can detect correspondences of toner hoppers and developers by providing a means, such as a DIP switch or non-volatile memory, to output electric signals that are coded according to toner colors or the like on respective toner hoppers and by developers and using the electric signals instead of using a lot of complicated parts.

The invention claimed is:

1. An electrophotographic apparatus comprising:

at least one developer including a first electric signal outputting means for outputting a first electric signal, at least one toner hopper for supplying toner to the developer, the toner hopper including a second electric signal outputting means for outputting a second electric signal, and detection means for detecting a correspondence of the developer and the toner hopper on the basis of the first electric signal and the second electric signal, wherein at least one of the first electric signal outputting means and the second electric signal outputting means is free from a memory.

2. An electrophotographic apparatus according to claim 1, wherein, of the first electric signal outputting means and the second electric signal outputting means, the one free from the memory comprises a multi-bit DIP switch.

3. An electrophotographic apparatus according to claim 1, wherein one of the first electric signal outing means and the second electric signal outputting means and the second electric signal outputting means comprises a non-volatile memory.

4. A electrophotographic apparatus according to claim 1, wherein both of the first electric signal outputting means and the second electric signal outputting means are free from a memory.

5. An electrophotographic apparatus according to claim 1, wherein toner color codes are assigned to the first and second electric signals.

6. An electrophotographic apparatus according to claim 5, wherein set cords are assigned to the first and second electric signals so as to allow developer-toner hopper sets to be distinguishable from each other even when the developer-toner hopper sets are the same as each other in toner-color.

7. An electrophotographic apparatus according to claim 1, wherein codes are assigned to the electric independently of toner colors.

8. An electrophotographic apparatus according to claim 1, wherein an error occurs if all zeros or all ones in the first and second electric signals are detected when codes are assigned to the first and second electric signals.

* * * * *